United States Patent [19]

Seiden et al.

[11] Patent Number: 5,058,364

[45] Date of Patent: Oct. 22, 1991

[54] PACKAGING MACHINE ADAPTED TO CONVERT POUCHES FROM EDGEWISE ADVANCE TO BROADWISE ADVANCE

[75] Inventors: Frederick C. Seiden; Jack E. Plahm; Scott J. Veix, all of Bradenton; Jerald R. Wiles, Sarasota, all of Fla.

[73] Assignee: Klockner-Bartelt, Inc., Sarasota, Fla.

[21] Appl. No.: 560,861

[22] Filed: Jul. 27, 1990

[51] Int. Cl.[5] ..... B65B 43/04; B65B 43/26

[52] U.S. Cl. ..... 53/455; 53/385.1; 53/386.1; 53/459; 53/562; 53/570

[58] Field of Search ..... 53/251, 384, 386, 455, 53/459, 492, 562, 568, 570, 384.1, 386.1, 385.1; 198/626.5

[56] References Cited

U.S. PATENT DOCUMENTS

| | | | |
|---|---|---|---|
| 3,427,780 | 2/1969 | Bock | 53/386 |
| 3,534,520 | 10/1970 | Moran | 53/455 X |
| 3,553,934 | 1/1971 | Johnson et al. | 53/562 |
| 4,108,300 | 8/1978 | Hayase et al. | 53/570 X |
| 4,263,768 | 4/1981 | Russell et al. | 53/384 |
| 4,330,288 | 5/1982 | Russell et al. | 493/239 X |
| 4,510,736 | 4/1985 | Müller | 53/570 X |
| 4,520,613 | 6/1985 | Claudio | 198/626.5 X |

*Primary Examiner*—John Sipos
*Assistant Examiner*—Linda B. Johnson
*Attorney, Agent, or Firm*—Leydig, Voit & Mayer, Ltd.

[57] ABSTRACT

Pouches in an interconnected strip are advanced edgewise to a cut-off station where the leading pouch is severed from the strip. Prior to being severed, the leading pouch is gripped by a transfer mechanism which lifts the severed pouch upwardly into pouch clamps carried on the opposing inboard runs of two chains adapted to advance the pouch broadwise through a filling section and along a path extending at right angles to the path of the pouch strip. Before being filled, the pouches are opened by shifting portions of the inboard runs of the two chains laterally toward one another and by pulling the side panels of the pouch away from one another with suction cups. The chains are adapted to be simultaneously adjusted in laterally opposite directions and through equal distances to enable the machine to be changed over to run pouches of different width while keeping pouches of all widths centered with respect to a common datum line as the pouches are advanced through the filling section.

19 Claims, 10 Drawing Sheets

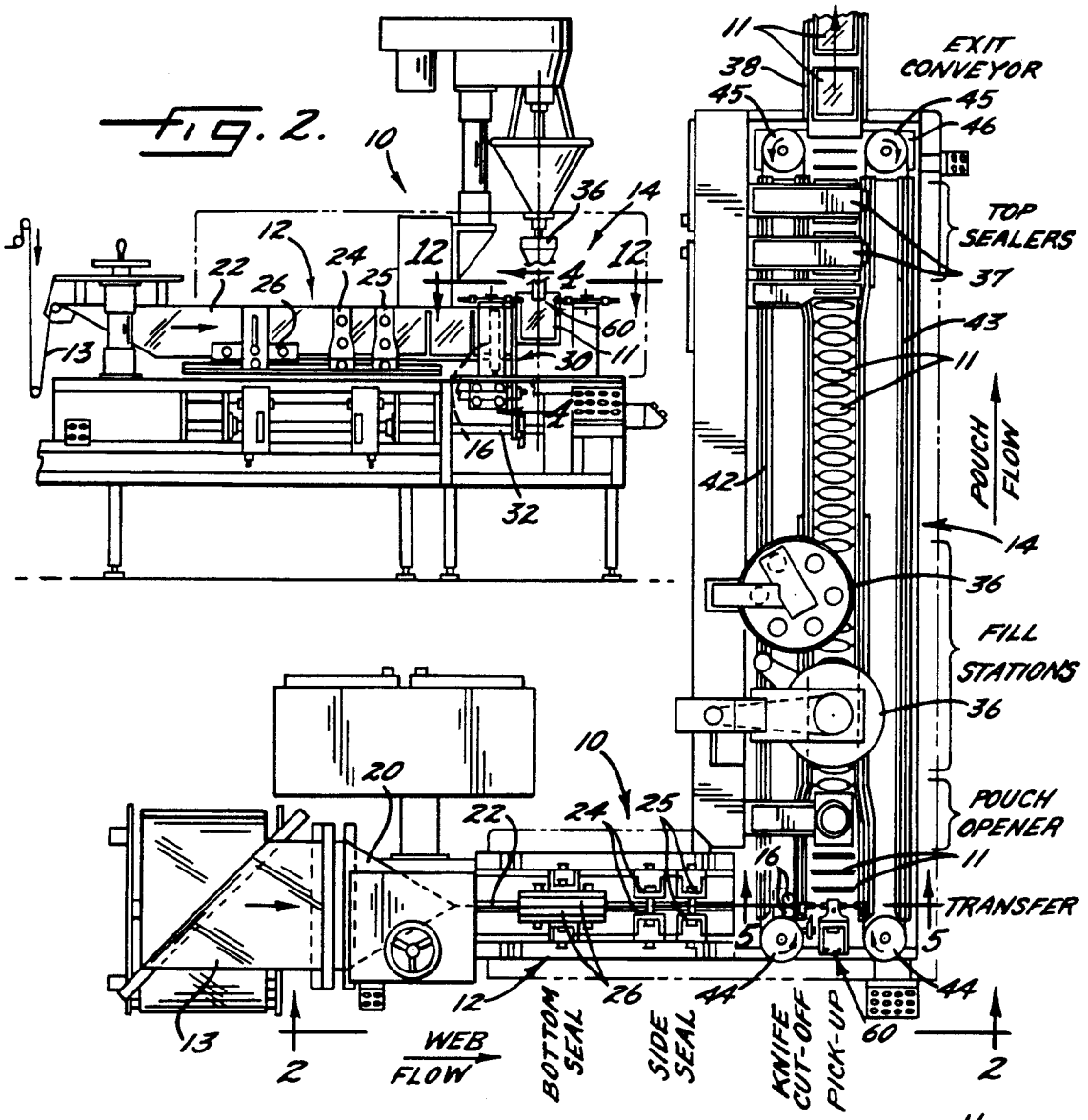
Fig. 2.
Fig. 1.
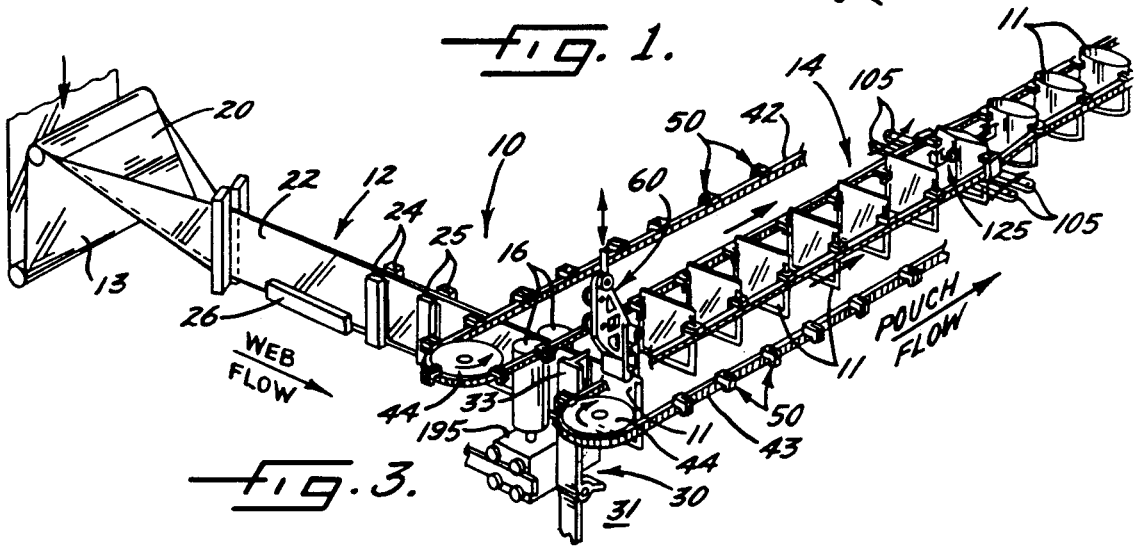
Fig. 3.

PACKAGING MACHINE ADAPTED TO CONVERT POUCHES FROM EDGEWISE ADVANCE TO BROADWISE ADVANCE

BACKGROUND OF THE INVENTION

This invention relates to a packaging machine of the type having a pouch making section for forming an elongated strip of interconnected pouches from a flexible web and further having a pouch filling section for filling and sealing the pouches after the pouches have been severed from the strip at the downstream end of the pouch making section. The machine of the invention preferably is of the intermittent motion type in which the web and the pouches are advanced intermittently or step-by-step and in which the pouch forming, filling and sealing operations take place when the web and the pouches dwell between successive steps.

It is well recognized in the packaging machine art that the pouches can be made at a much faster rate than the pouches can be filled since a relatively long dwell period is required to fill the pouches. Even if multiple filling mechanisms are used to fill each pouch during successive dwell periods, the pouch filling section of a standard packaging machine must run at the same velocity as the pouch making section. While the dynamic considerations involved in running the pouch making section at a high velocity can be dealt with, the dynamic factors involved in running the pouch filling section at the same high velocity present a much more difficult problem.

It also has been recognized, for example, in Russell et al U.S. Pat. No. 4,330,288, that advantages can be gained by advancing the pouches broadwise through the pouch filling section rather than edgewise as is conventional in most packaging machines of the type under consideration. By advancing the pouches broadwise through the pouch filling section, the pitch between adjacent pouches can be significantly reduced and thus the velocity required to advance each pouch through a step is decreased so as to ease dynamic demands at the filling section. Moreover, broadwise advance of the pouches through the filling section greatly simplifies changing over of the machine to handle pouches of different widths. By virtue of the broadwise advance, the pitch between the pouches may be maintained the same for pouches of all widths and thus various mechanisms such as the filler and top sealer may be located at the same position for pouches of all widths so as to avoid the need of adjusting the locations of these mechanisms each time the machine is changed over to handle pouches of a different width.

While the Russell et al patent recognizes the advantages of forming pouches while the pouches are advanced edgewise and then filling the pouches during a broadwise advance, the machine disclosed in the patent is very complex and expensive. The machine requires a very sophisticated mechanism for grabbing hold of individual pouches and physically turning each pouch from a position of edgewise advance to a position of broadwise advance.

When pouches are advanced broadwise through a filling section, difficulty also is encountered in opening the pouches preparatory to filling the pouches. One conventional way of opening the pouches is by effecting lateral shifting of the clamps which hold the sides of the pouches. Russell et al U.S. Pat. No. 4,263,768 discloses pouch-holding clamps which are adapted to be moved laterally toward one another in order to pucker the mouth of the pouch into an open condition. This arrangement, however, requires that each clamp be capable of shifting individually relative to the chain which carries the clamp. The clamps are, therefore, complex and expensive.

SUMMARY OF THE INVENTION

The general aim of the present invention is to provide a new and improved intermittent motion packaging machine which is capable of effecting broadwise advance of conventionally formed pouches through a filling section and which is significantly less complex, lower in cost and more trouble-free in operation than prior machines having the same general capability.

A more detailed object of the invention is to achieve the foregoing through the provision of a machine in which pouches that are made while being advanced edgewise through a pouch forming section are elevated and advanced broadwise through a pouch filling section without need of turning the pouch to change its mode of advance.

A related object is to provide a new and improved pouch elevating mechanism which grips each pouch as it is severed from the strip of pouches and then elevates the pouch for broadwise advance through the filling section by a pair of chains having opposing inboard runs which move transversely of the strip.

Still another object of the invention is to use pouch clamps to help open the pouches without need of moving the clamps relative to the chains which carry the clamps. This is achieved by laterally shifting successive portions of at least one chain so as to effect lateral shifting of the clamps and opening of the pouches while eliminating the need for complex clamps adapted to shift relative to the chain.

A further object is to positively shift a portion of the chain laterally while a pouch dwells in an opening station and to keep the chain in a laterally shifted condition as the pouch advances downstream from the opening station.

The invention also resides in the use of two laterally spaced chains for carrying the pouches through the pouch filling section of the machine and to the provision of unique means for selectively and simultaneously adjusting the chains laterally in opposite directions and through equal distances in order to facilitate changing over of the machine to run pouches of a different width.

These and other objects and advantages of the invention will become more apparent from the following detailed description when taken in conjunction with the accompanying drawings.

BRIEF DESCRIPTION OF THE DRAWINGS

FIG. 1 is a top plan view of a new and improved packaging machine incorporating the unique features of the present invention.

FIG. 2 is a reduced elevational view of the machine as seen from the front of the pouch making section and along the line 2—2 of FIG. 1.

FIG. 3 is a perspective view which schematically shows the flow of pouches through the machine.

DETAILED DESCRIPTION OF THE PREFERRED EMBODIMENT

Figure 4:
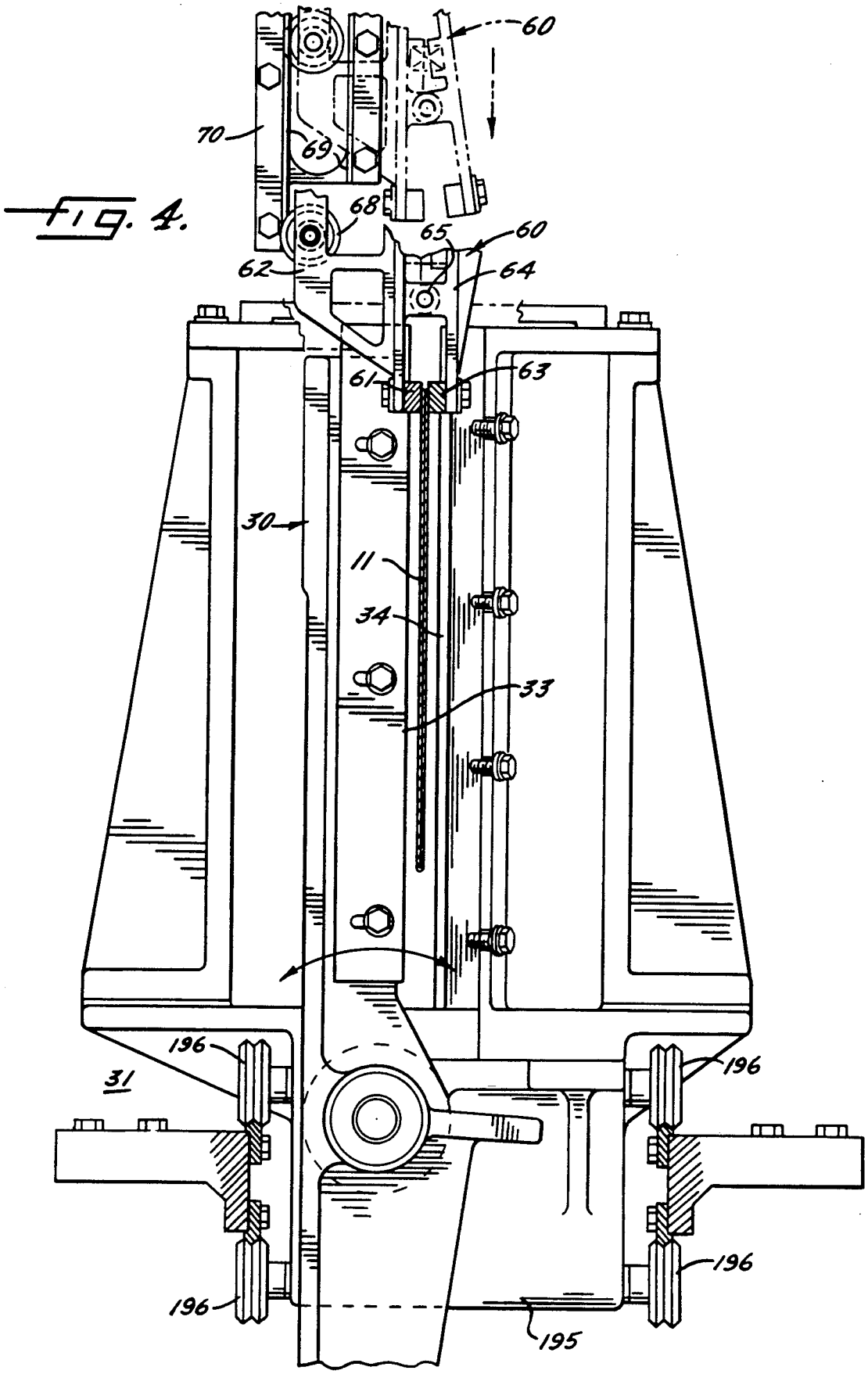
FIG. 4 is an enlarged fragmentary cross-section taken substantially along the line 4—4 of FIG. 2.

As shown in the drawings for purposes of illustration, the invention is embodied in a packaging machine 10 for forming, filling and sealing substantially flat pouches 11 made of flexible material. The specific machine which has been illustrated herein is of the intermittent motion type in that the pouch material and pouches are advanced step-by-step through the various stations of the machine and dwell in the stations during the performance of packaging operations.

In many respects, the machine 10 may be of the same general type as disclosed in Johnson et al U.S. Pat. No. 3,553,934 to which reference may be made for many details of construction. Basically, the machine comprises a pouch making section 12 (FIG. 1) which forms the pouches from a web 13 of flexible, heat-sealable material as the web is advanced in a horizontal direction along a predetermined path. Downstream of the pouch making section is a pouch filling section 14 to which the newly formed pouches are transferred for filling and closing.

To form each pouch 11, a length of web 13 is pulled from a supply roll by a motor-driven unwind roller and is advanced step-by-step through the packager by a pair of intermittently rotatable feed rolls 16 (FIG. 3) driven by a servomotor. The feed rolls are driven such that they advance the web through steps each equal in length to the width of each pouch. During the advance, the web is pulled beneath a plow 20 which folds the web upwardly to form an elongated strip 22 defined by two face-to-face panels whose lower margins are joined by a bottom fold. When the strip dwells between successive steps, two coacting heated bars 24 form vertically extending seals at longitudinally spaced increments along the strip, such seals defining the side seals of the pouches 11. The side seals subsequently may be chilled by a pair of coacting cooling bars 25. If desired, a pair of heated bars 26 may be positioned along the path to form seals along the bottom fold of the strip.

After the side seals have been formed, a cutting unit 30 (FIG. 3) positioned along the path at a cut-off station 31 cuts through each seal about midway between the edges thereof in order to separate each leading pouch 11 from the strip 22, there herein being one pouch cut from the strip each time the strip dwells. The cutting unit comprises a swingable blade 33 (FIG. 4) driven by a cycle shaft 32 and coacting with a fixed blade 34. Each pouch is cut from the strip when the pouch dwells in the cutting station with its trailing margin located between the blades.

Subsequent to being severed from the strip 22, each pouch 11 is advanced intermittently through the pouch filling section 14 of the machine 10. In that section, each pouch is opened widely at an opening station 35 (FIG. 12), is filled with product by one or more filling mechanism 36 (FIG. 1), is sealed across its top by top sealing mechanisms 37 and then is discharged from the machine by an exit conveyor 38.

In a machine 10 of the type described thus far, the pouch making section 12 is capable of operating at a relatively high cycle rate to produce a relatively large number of pouches 11 in a given period of time. The pouch filling section 14, however, cannot operate at such a high cycle rate and, in a standard packaging machine, the pouch filling section simply cannot be operated at a sufficiently high cycle rate to handle the maximum pouch output which the pouch making section is capable of producing. Assume, for example, that the pouch making section 12 produces one pouch during each index cycle and is capable of producing as many as 200 pouches per minute. In a standard machine, the pouch filling section simply cannot be operated at a cycle rate much higher than 150 pouches per minute and thus cannot accommodate the maximum pouch output of the pouch making section. There are two primary factors which contribute to the inability of a standard pouch filling section to be operated at the same high cycle rate as the pouch making section. First, a certain amount of dwell time is required to fill the pouches. While the time available for filling the pouches can be increased by using multiple filling mechanisms rather than a single filling mechanism, difficulty nevertheless is still encountered in a standard machine in dealing with the dynamic problems resulting from starting and stopping the filling section at a cycle rate significantly higher than 150 pouches per minute.

As discussed above, the packaging machine disclosed in Russell et al U.S. Pat. No. 4,330,288 attempts to increase the cycle rate of the pouch filling section of the machine by moving the pouches broadwise through the pouch filling section rather than edgewise. A broadwise advance of the pouches enables a reduction in the pitch between adjacent pouches and enables a constant pitch to be maintained for pouches of all widths. As a result, the pouches may be moved through the pouch filling section at a lower dynamic velocity and at a higher cycle rate and, in addition, the machine may be changed over to run pouches of a different width in a relatively easy manner.

The present invention contemplates the provision of a new and improved machine 10 which converts movement of the pouches 11 from the edgewise to broadwise in a much simpler and far more reliable manner than has been possible heretofore. In general, this is achieved by gripping each leading pouch at the cut-off station 31 just prior to severing of the pouch from the strip 22, by elevating the severed pouch upwardly from the strip, and then by advancing the pouch through the pouch filling section 14 along a path which extends at right angles to the path of the strip. In this way, a pouch which is advanced edgewise into the cut-off station 31 is advanced broadwise out of the station and through the filling section 14 without need of physically turning the pouch.

Figure 24:
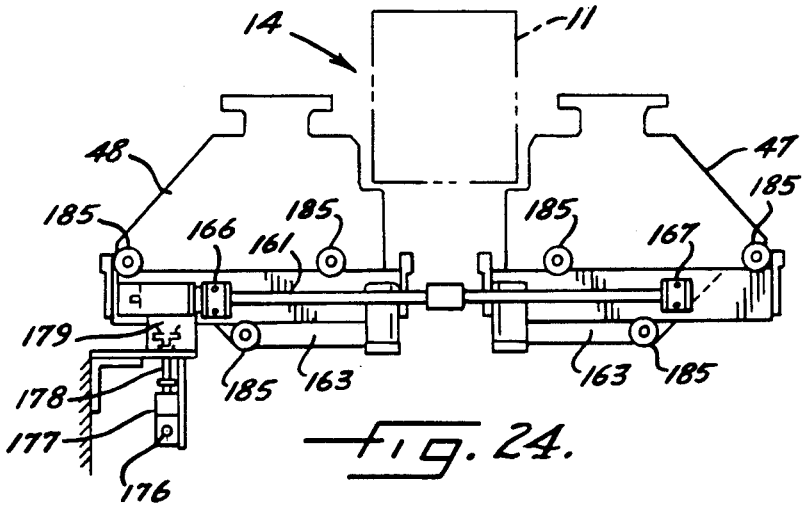

To effect broadwise advance of the pouches 11 through the filling section 14, the machine 10 includes two-side-by-side conveyors extending at right angles to the path of the strip 22 and having upstream ends located adjacent the cut-off station 31. The conveyors include intermittently driven endless chains 42 and 43 disposed in a horizontal plane and having opposing inboard runs which are adapted to advance away from the strip 22 at right angles thereto. Each chain is trained around upstream and downstream sprockets 44 and 45 (FIG. 1), the downstream sprocket of each chain being connected to be periodically indexed by a drive mechanism 46. The sprockets are supported on mounting bases 47 and 48 (FIG. 24) for the chains 42 and 43, respectively.

Figure 5:
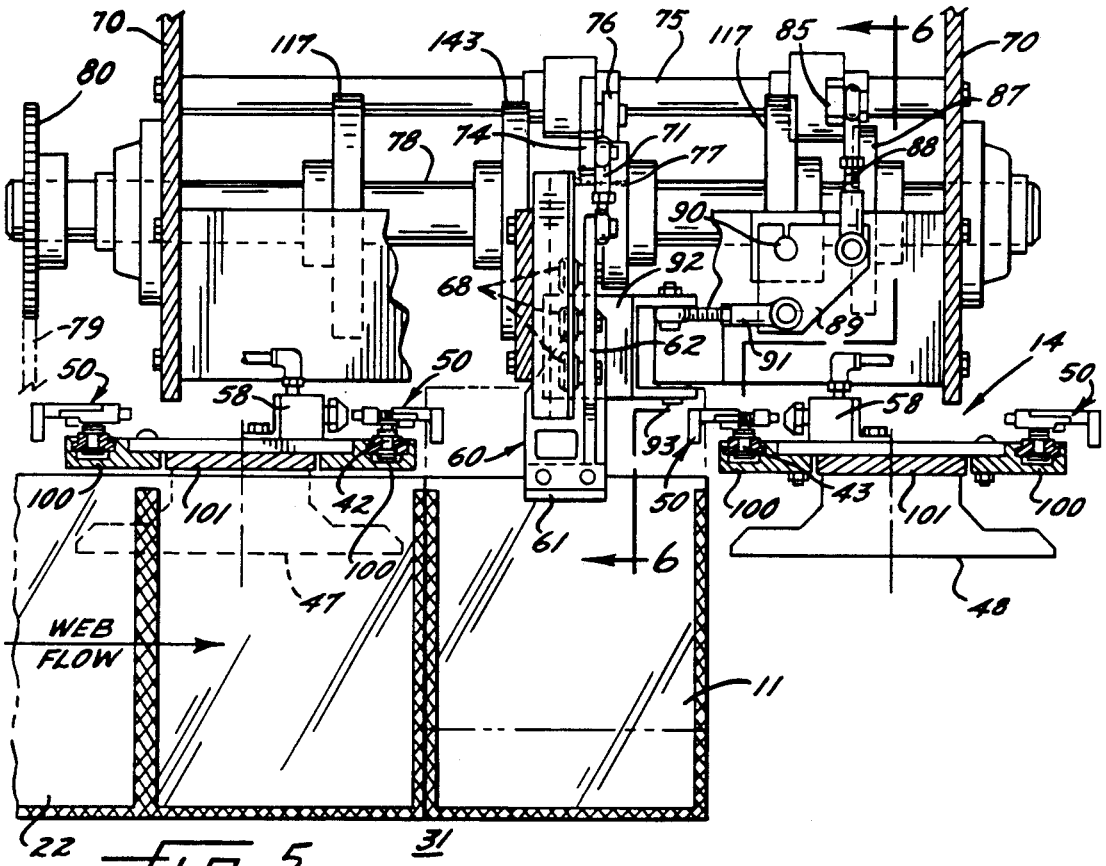
FIG. 5 is an enlarged fragmentary cross-section taken substantially along the line 5—5 of FIG. 1.
Figure 6:
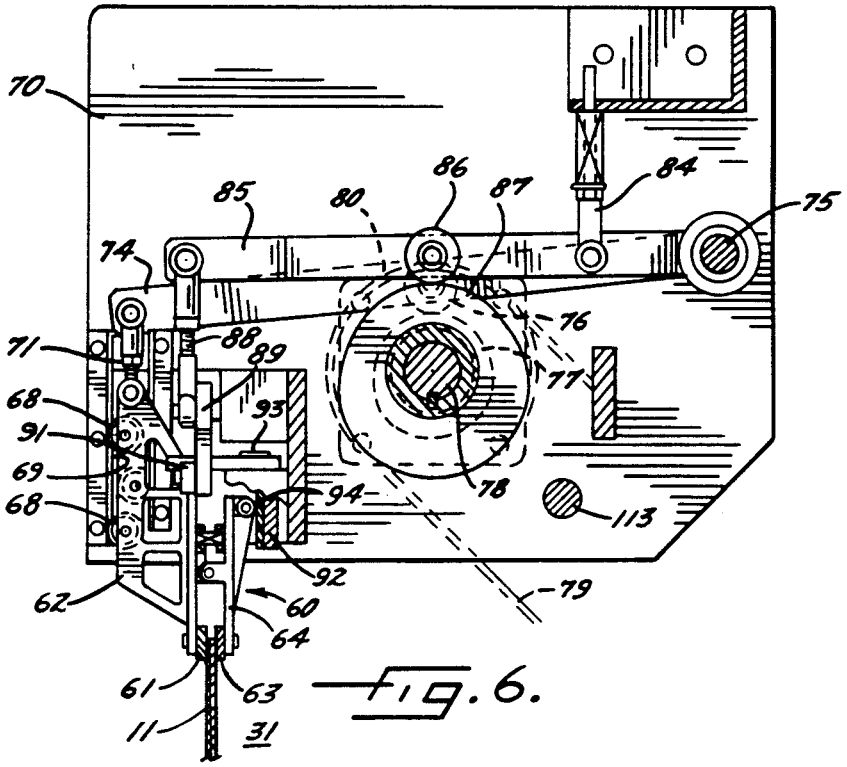
FIG. 6 is an enlarged fragmentary cross-section taken substantially along the line 6—6 of FIG. 5.
Figure 12:
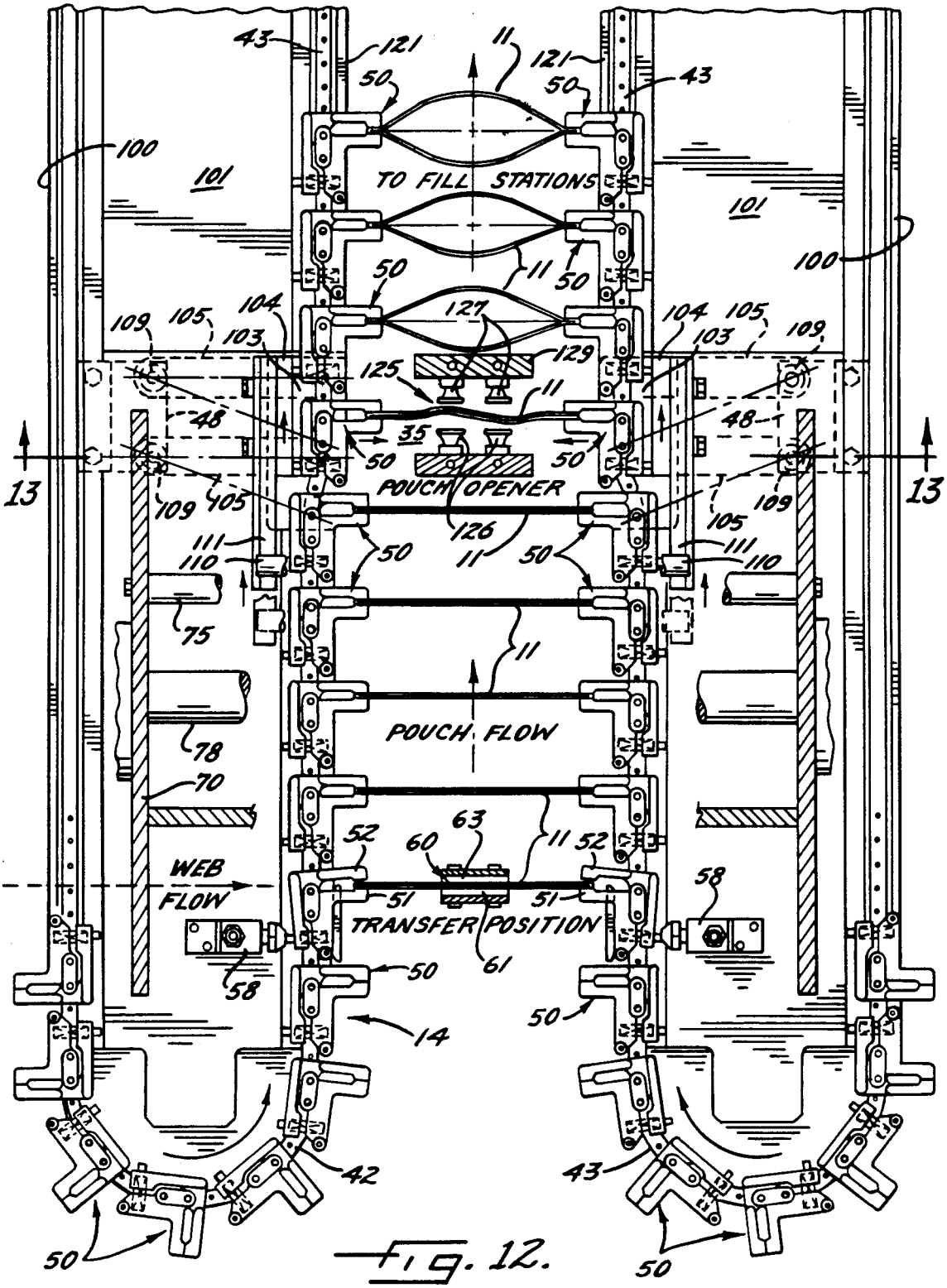
FIG. 12 is a enlarged fragmentary cross-section of the pouch filling section as taken substantially along the line 12—12 of FIG. 2.

Secured to and spaced along each chain 42 and 43 are several pouch clamps 50. In general, each clamp includes fixed and movable jaws 51 and 52 (FIGS. 8 and 11) adapted to grip a side margin of the pouch 11 near its upper end. Each fixed jaw is carried rigidly by the respective chain while each movable jaw is pivoted on the chain at 53 (FIG. 11) to swing between open and closed positions relative to the fixed jaw. An operating arm 54 is connected to the movable jaw and, when the arm is engaged by the plunger 57 of a reciprocating pneumatic actuator 58, the movable jaw is pivoted to its open position. Upon retraction of the plunger, a coiled compression spring 59 acts against the arm 54 to pivot the movable jaw to and hold the movable jaw in its closed position. Actuators 58 are located near the upstream end portions of the chains 42, 43 as shown in FIGS. 5 and 12 for the purpose of opening the clamps 50 to pick up pouches. Similar actuators (not shown) are located near the downstream end portions of the chains in order to open the clamps and release filled pouches to the exit conveyor 38.

The clamps 50 on the chain 42 are paired with the camps on the chain 43. Each time the chains dwell, one clamp on the inboard run of the chain 42 is disposed in laterally spaced opposing relation with a clamp on the inboard run of the chain 43 at a transfer position (FIG. 12) immediately above the leading pouch 11 dwelling in the cut-off station 31. As soon as the clamps dwell, the upstream actuators 58 are operated to open the clamps at the transfer position.

In carrying out the invention, an elevator mechanism 60 (FIGS. 4 to 9) grips the leading pouch 11 in the cut-off station 31 and then lifts the pouch upwardly into the pair of clamps 50 dwelling at the transfer position. Herein, the elevator mechanism includes a fixed jaw 61 mounted on a carriage 62 and adapted to coact with a movable jaw 63 carried by an arm 64 which is pivotally supported on the carriage at 65 to enable the movable jaw to swing between open and closed positions relative to the fixed jaw. A coil spring 66 is compressed between the carriage 62 and the arm 64 and biases the movable jaw 63 toward its closed position. The jaws 61 and 63 are centered laterally with respect to the pouch 11 dwelling in the cut-off station 31 and, when the movable jaw is closed, the jaws grip the upper end portion of such pouch midway between the side seals thereof.

The carriage 62 is adapted to be shifted upwardly and downwardly in order to move the jaws 61 and 63 between lowered and raised positions For this purpose, three vertically spaced V-groove rollers 68 (FIG. 7) are journaled by the carriage and are adapted to ride along V-tracks 69 on a fixed support structure 70. In order to effect up and down movement of the carriage 62, a link 71 (FIG. 7) is pivotally connected at its lower end at 72 to the upper end of the carriage and is pivotally connected at its upper end at 73 to the free end of an elongated lever 74 whose opposite end is connected to swing about a pivot rod 75 (FIGS. 5 and 6) on the support structure 70. A roller-type cam follower 76 is journaled on the lever between the ends thereof and is positioned to ride on the periphery of a cam 77 which is connected securely to a rotatable shaft 78 on the support structure. The shaft is adapted to be rotated in timed relation with the advance of the strip 22 and the advance of the clamps 50 by a chain 79 (FIG. 5) connected to a sprocket 80 on one end of the shaft.

Figures 7, 8, 9, 10, 11:
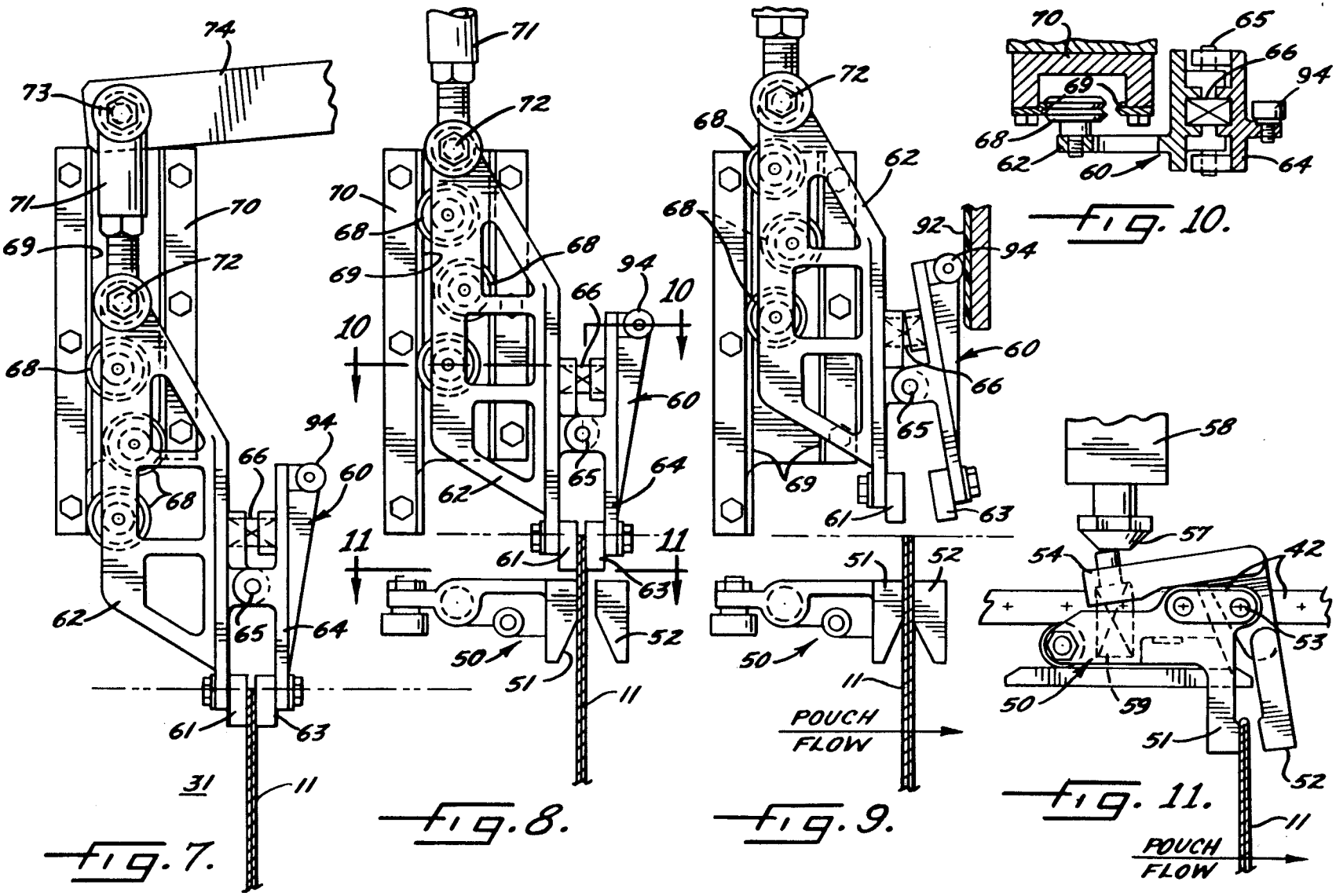
FIG. 7 is an enlarged view of the pouch elevator illustrated in FIG. 4 and shows the elevator gripping a pouch as the pouch is cut off from the pouch strip.
FIG. 8 is a view similar to FIG. 7 but shows the elevator raising the pouch after the pouch has been cut from the strip.
FIG. 9 is also a view similar to FIG. 7 but shows the elevator having released the pouch for advance through the pouch filling section of the machine.
FIGS. 10 and 11 are fragmentary cross-sections taken substantially along the lines 10—10 and 11—11, respectively, of FIG. 8.

When the cam 77 is rotated by the shaft 78, the lever 74 is rocked upwardly and downwardly to raise and lower the carriage 62. As a pouch 11 is advanced into the cut-off station 31, the carriage is located in a raised position with the movable jaw 63 in an open position as shown in phantom lines in FIG. 4. Once the pouch dwells, the carriage 62 is lowered to cause the jaws 61 and 63 to straddle the upper end portion of the pouch, after which the movable jaw 63 is closed in order to grip and control the pouch during cutting of the pouch from the strip 22 (see FIGS. 4 to 7). As soon as the pouch has been cut off, the carriage 62 is moved upwardly to cause the jaws to lift the pouch as shown in FIG. 8. As an incident thereto, the upper end portions of the side margins of the pouch pass between the jaws 51 and 52 of the open clamps 50 dwelling in the transfer position (see FIG. 8). The carriage stops momentarily while the clamps 50 are closed to grip the side margins of the pouch. The jaw 63 then is opened to release the pouch and thereafter the carriage 62 is raised to its uppermost position (FIG. 9) to lift the jaws 61 and 63 clear of the pouch and to free the pouch for broadwise advance through the filling section 14 by the clamps 50.

Opening of the movable jaw 63 of the elevator mechanism 60 is effected by a lever 85 (FIG. 6) pivotally mounted on the shaft 75 and carrying a follower 86 which engages a cam 87 on the shaft 78. The upper end of a link 88 is pivotally connected to the free end of the lever while the lower end of the link is pivotally connected to a plate 89 supported to pivot at 90 by the support structure 70. A horizontally extending link 91 is pivotally connected at one end to the plate 89 and is pivotally connected at its opposite end to an actuating paddle 92 (FIGS. 5, 6 and 9) which is pivotally connected at 93 to the support structure 70.

When the lever 85 is rocked in one direction, the paddle 92 is turned in one direction about the pivot 93 and engages a roller 94 on the upper end of the arm 64 as shown in FIG. 9 so as to cause the arm to swing counterclockwise about the pivot 65 and open the movable jaw 63 of the elevator 60. Rocking of the lever 85 in the opposite direction pivots the paddle 92 away from the roller 94 to enable the spring 66 to close the movable jaw 63.

With the foregoing arrangement, the pouches 11 are transferred from an edgewise advance to a broadwise advance without ever needing to physically turn the pouch. Good control is maintained over the pouch at all times since the pouch is merely lifted vertically by the elevator 60 and then gripped by the clamps 50. The upper ends of pouches of all heights are maintained along a common top datum line and thus there is no need to adjust either the vertical position of the elevator 60 or the vertical position of the pouch clamps 50 when the machine 10 is changed over to run pouches of a different height.

As discussed above, two important advantages are gained by advancing the pouches 11 broadwise through the filling section 14. First, and as will be explained in more detail subsequently, pouches of all widths are advanced while centered laterally with respect to a common datum line which remains constantly centered between the inboard runs of the chains 42 and 43. Moreover, the spacing or pitch between adjacent pouches remains the same regardless of the width of the pouches. As a result, the machine 10 may be changed over to run pouches of different widths without need of adjusting the filler mechanisms 36, the top sealing mechanisms 37 and other mechanisms which operate on the pouches along the filling section 14. Accordingly, changing over of the machine to handle pouches of a different width may be effected in a comparatively fast and simple manner.

The second important advantage which is gained from broadwise advance of the pouches 11 through the filling section 14 is that the pitch between adjacent pouches is reduced significantly when compared to the pitch which exists at the pouch making section 12. The present machine 10 is capable of making pouches of a width as great as $7\frac{3}{4}''$. When the pouches are advanced broadwise through the filling section, however, the pitch between adjacent pouches is reduced to $3\frac{1}{8}''$, meaning that each pouch need move only through that distance during each step. As a result, the chains 42 and 43 may move each pouch at a lower dynamic velocity than is the case of a machine operating at the same cycle rate but with pouches at a larger pitch. Thus, the cycle rate of the machine may be increased without exceeding the dynamic limitations of the chains.

It is necessary to open the pouches 11 widely in order to effect rapid filling of the pouches. Typically, opening of pouches has been effected in part by moving the clamp at one side seal of the pouch toward the clamp at the other side seal in order to cause the pouch to pucker open. In accordance with another aspect of the present invention, the pouches are opened in this manner but without need of moving the pouch clamps 50 relative to the chains 42 and 43. As a result, comparatively simple and inexpensive clamps may be employed.

More specifically, puckering open of the pouches 11 by the clamps 50 is effected by positively moving a portion of the inboard run of at least one chain 42, 43 laterally toward the other chain at the pouch opening station 35. In the preferred embodiment, portions of the inboard runs of both chains are moved laterally toward one another at the opening station.

Figure 14:
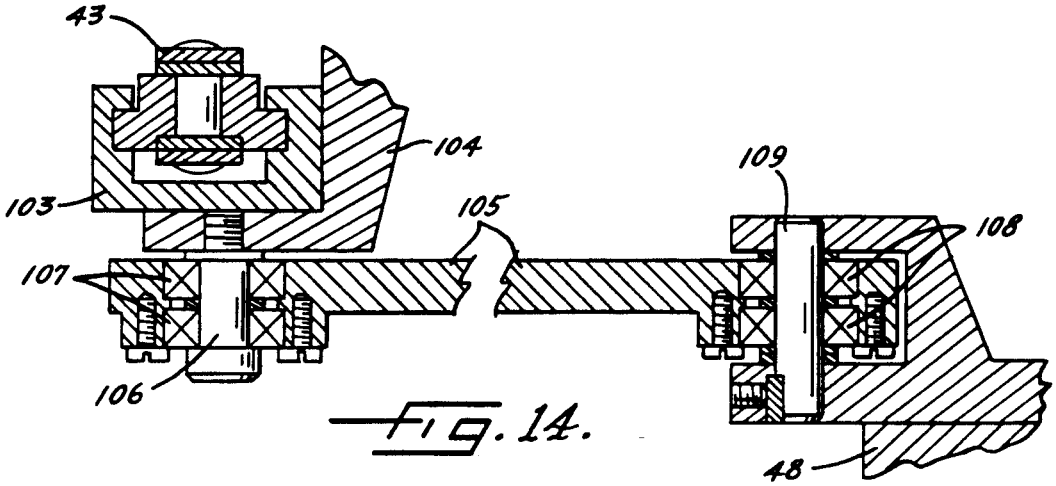
FIG. 14 is an enlarged view of certain components shown in FIG. 13.
Figure 15:
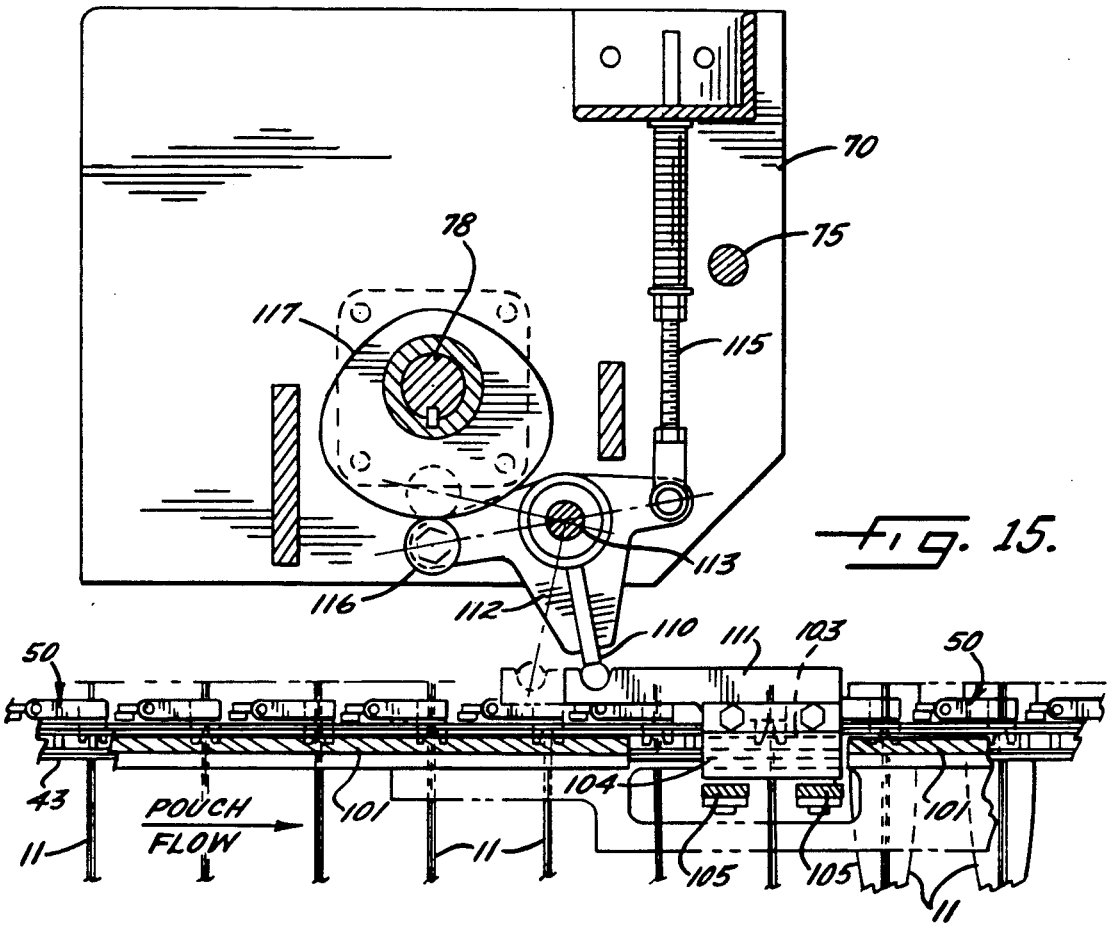
FIGS. 15 and 16 are fragmentary cross-sections taken substantially along the lines 15—15 and 16—16, respectively, of FIG. 13.
Figure 16:
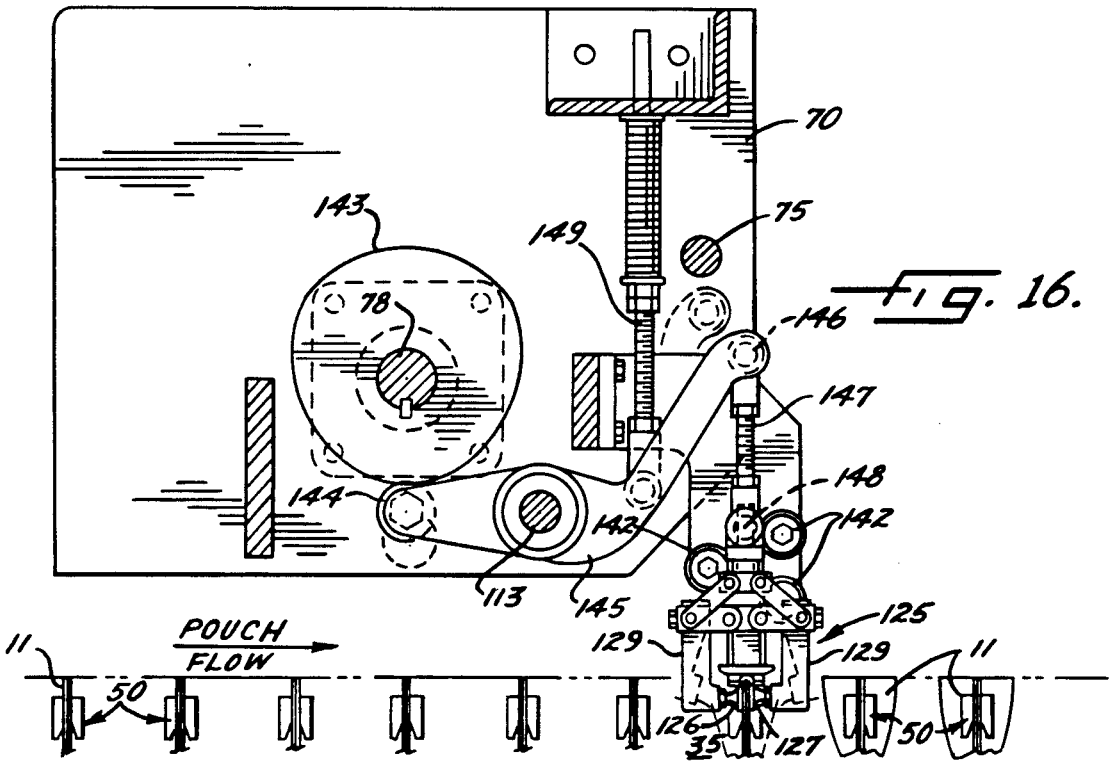

As shown most clearly in FIG. 5, the straight runs of each of the chains 42, 43 travel within and are guided by channel-shaped members 100 which are attached to a central plate 101 located between the runs and supported on the base 47, 48. Adjacent the opening station 35, a separately formed chain guiding channel 103 (FIG. 14) is attached to a movable carrier 104 located along the inboard side of and formed separately of each plate 101. The inboard ends of two laterally extending parallel arms 105 (FIGS. 12, 14 and 15) are connected pivotally to the lower side of each carrier, each connection being effected by a screw 106 which is supported within bearings 107 on the arm. The outboard end of each parallel arm is pivotally mounted on the base 47, 48 by bearings 108 supported on an upright pin 109.

Figure 13:
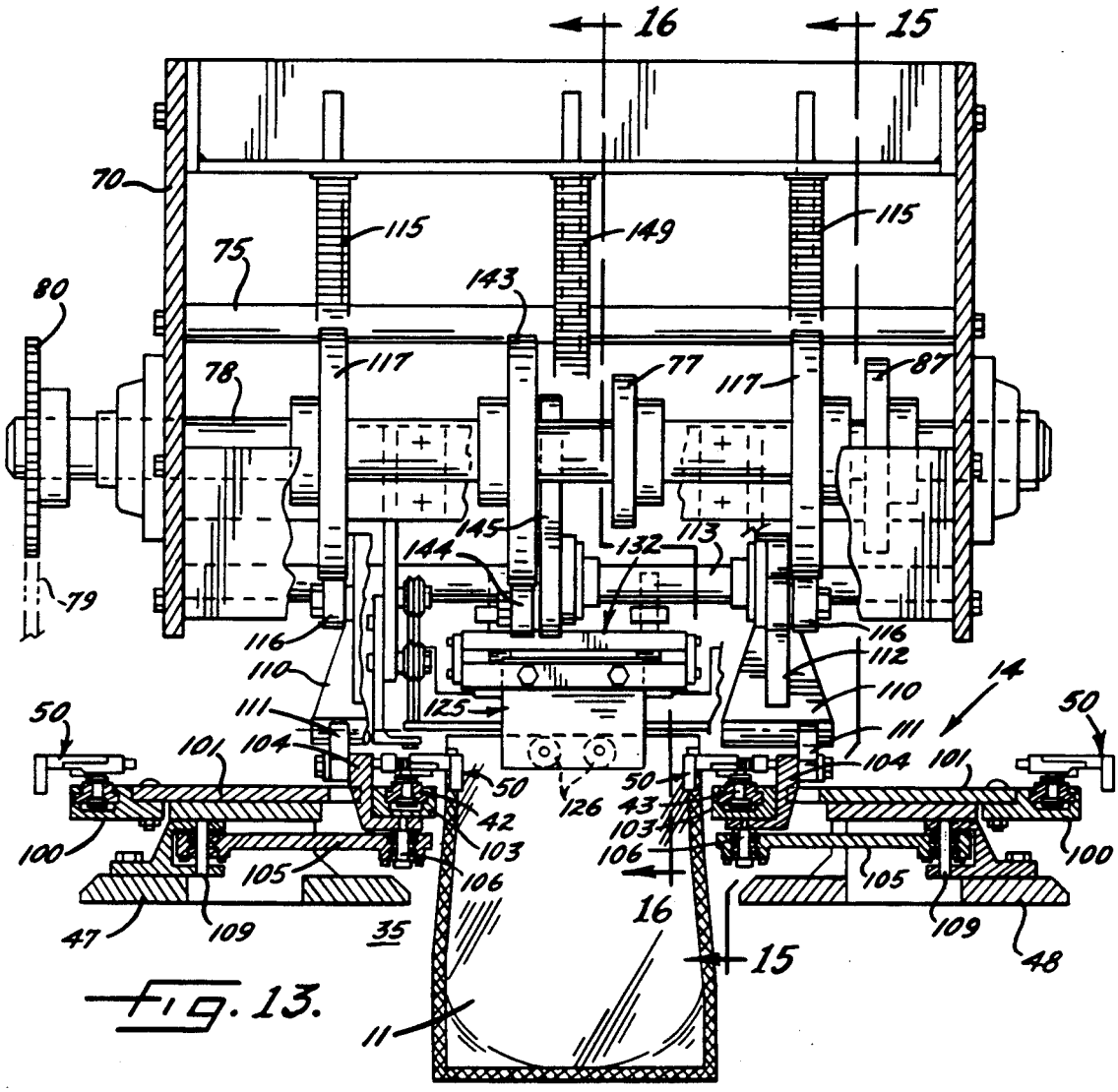
FIG. 13 is a fragmentary cross-section taken substantially along the line 13—13 of FIG. 12.

The parallel arms 105 mount each movable chain-guiding channel 103 for lateral shifting relative to the fixed channel 100. When the arms are swung in one direction, the movable channel 103 shifts from a normal position in alignment with the fixed channel 100 to an actuated position spaced laterally inwardly from the fixed channel. Swinging of the arms in the opposite direction returns the movable channel to its normal position. To effect such swinging, the lower cylindrical end of a link 110 (FIGS. 13 and 15) is connected to an extension 111 of the carrier 104. Each link is carried by a bellcrank 112 (FIG. 15) which is supported to turn about a laterally extending shaft 113 journaled by the support structure 70. One arm of the bellcrank is connected to a spring-loaded rod 115 which urges the bellcrank clockwise about the shaft 113. The other arm of the bellcrank carries a follower 116 adapted to engage the periphery of a cam 117 secured to the shaft 78. As each cam rotates, the bellcrank is rocked back and forth and acts through the link 110 to swing the arms 105 back and forth about the pivots 109. The arms act through the carrier 104 to shift the movable chain guide 103 between its normal and actuated positions.

During advance of a pouch 11 into the opening station 35, the two movable chain guides 103 are disposed in their normal positions and are aligned with the stationary guides 100. As soon as the pouch dwells, the arms 105 are swung in a direction to shift the movable guides 103 laterally toward one another. This causes those portions of the chains 42, 43 disposed in the guides 103 to move laterally toward one another and thus the two pouch clamps 50 carried by the deflected chain portions also move toward one another. As a result of such movement, the upper end portions of the two side seals of the pouch are moved toward one another so as to cause the mouth of the pouch to pucker open. At substantially the same time, the pouch is fully opened by mechanism to be described subsequently, and then the pouch is indexed out of the opening station 35. During such indexing, the chains 42, 43 enter guide channels 121 (FIG. 12) which are offset inwardly from the guide channels 100 and which are aligned with the movable channels 103 when the latter are in their actuated positions. Thus, the channels 121 keep the clamps 50 in inwardly shifted positions so as to hold the pouch open as it is advanced further along the filling section 14.

Shortly after the chains 42, 43 index, the arms 105 are swung reversely to return each movable guide channel 103 to its normal position to receive the next length of chain. That length of chain then is shifted laterally inwardly during the next dwell period.

By virtue of shifting the chains 42 and 43, puckering of the pouches 11 with the clamps 50 is effected without need of supporting the clamps for movement relative to the chains. Accordingly, comparatively simple and inexpensive clamps may be employed. Also, the swingable arms 105 and associated actuating mechanism enable initial puckering of the pouches to be effected during a dwell period when the chains are stationary. As described immediately below, initial puckering of the pouches during a dwell period facilitates full opening of the pouches.

Figure 17:
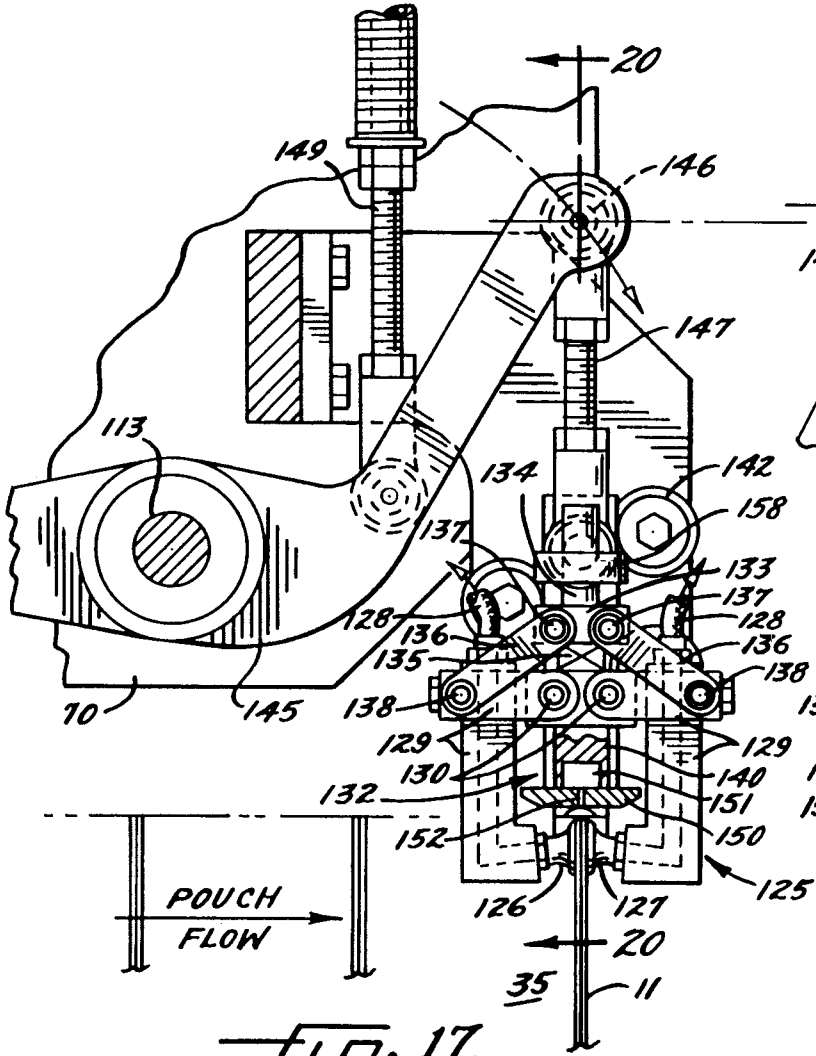
FIG. 17 is an enlarged view of the pouch opening mechanism illustrated in FIG. 16 and shows the mechanism preparatory to opening a pouch.
Figure 20:
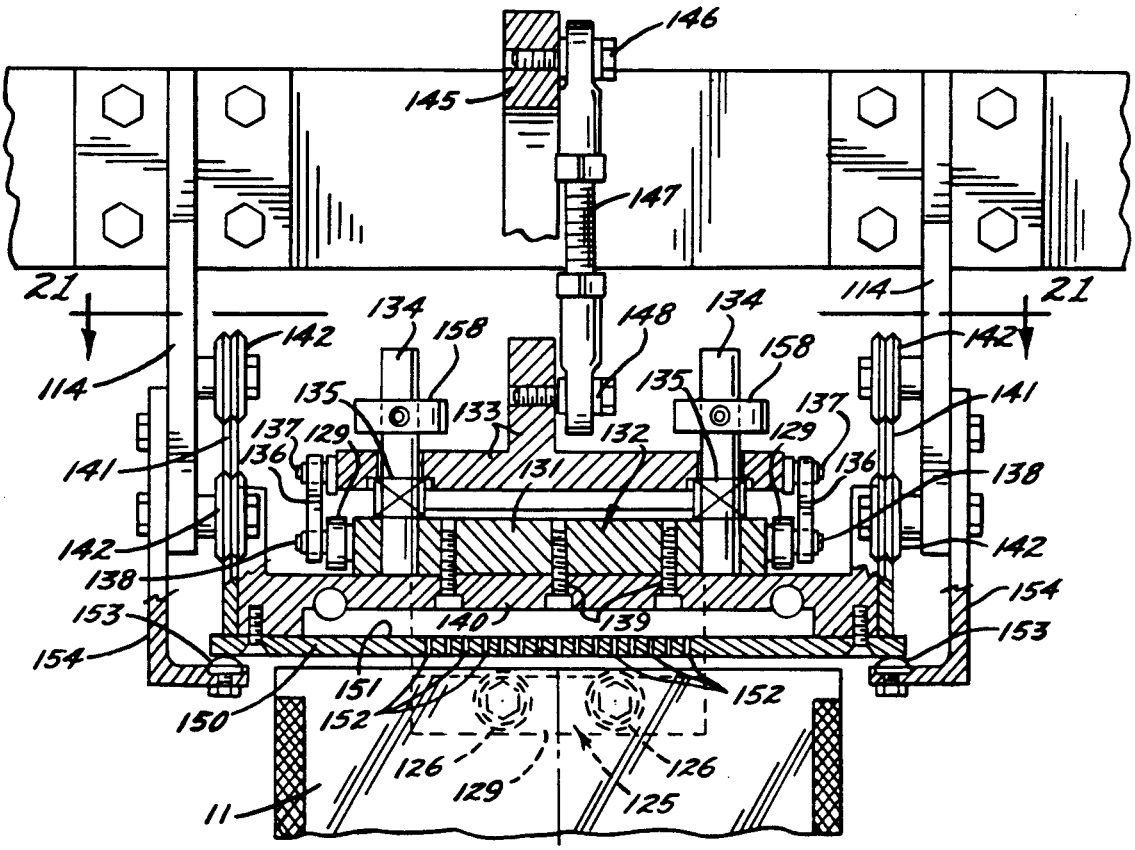
FIG. 20 is a fragmentary cross-section taken substantially along the line 20—20 of FIG. 17.
Figure 21:
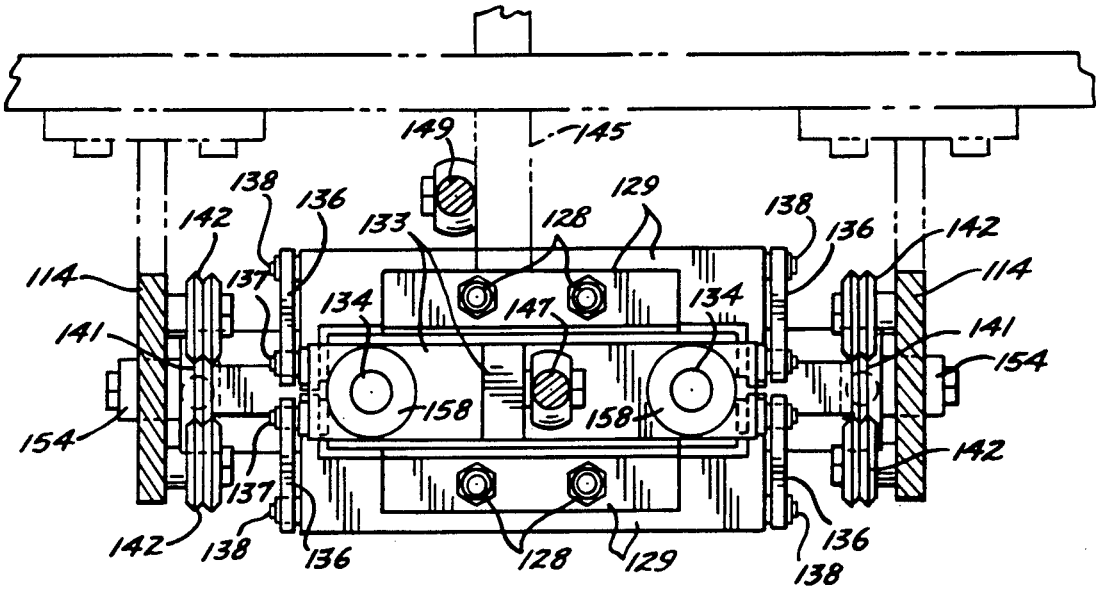
FIG. 21 is a fragmentary cross-section taken substantially along the line 21—21 of FIG. 20.
Figure 22:
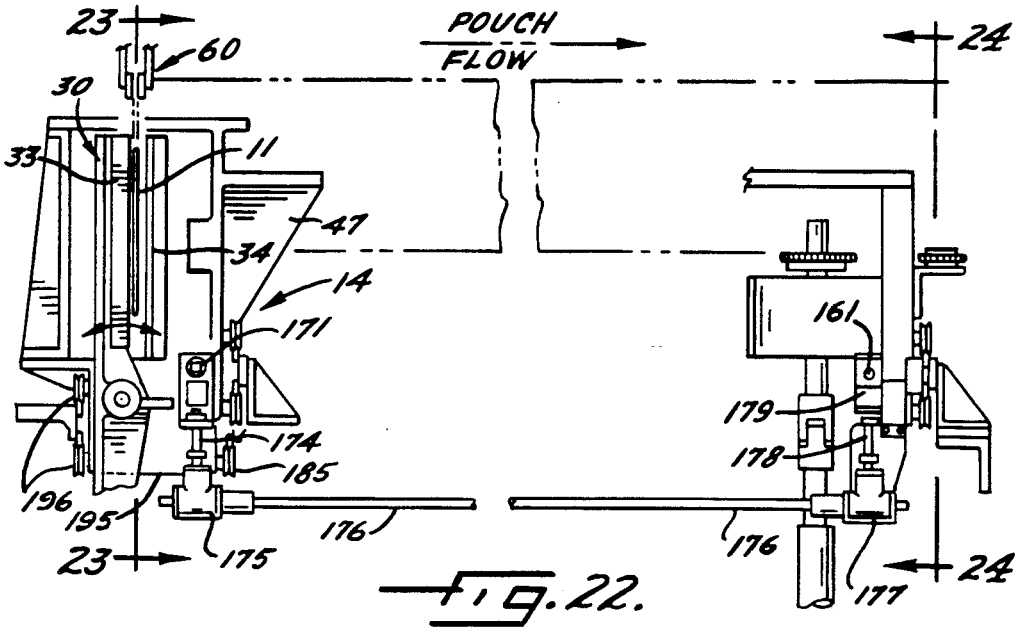
FIG. 22 is a fragmentary elevational view of the machine as seen from the front of the pouch filling section.

Full opening of the pouches 11 is effected at the opening station 35 by an opening mechanism 125 (FIGS. 16 to 20) which engages the opposing side panels of each pouch and pulls the panels away from one another. Specifically, the opening mechanism includes a pair of laterally spaced upstream suction cups 126 (FIGS. 12 and 17) and an opposing pair of downstream suction cups 127. Flexible lines 128 (FIG. 17) communicate with the cups and enable a vacuum to be selectively applied to and released from the cups.

Each pair of suction cups 126, 127 is carried on the lower end portion of an arm 129 (FIG. 17) which is pivotally connected at 130 to the lower plate 131 (FIG. 20) of a carriage 132 having an upper plate 133 which is supported to move vertically relative to the lower plate by pins 134. Coil springs 135 are telescoped over the pins and are compressed between the two plates to urge the plates away from one another.

Two links 136 (FIG. 17) are pivotally connected at 137 to each end of the upper plate 133 of the carriage 132 and are pivotally connected at 138 to the arms of the suction cups 126, 127. Secured rigidly to the lower plate 131 by screws 139 (FIG. 20) is still another plate 140 whose ends carry a pair of upwardly extending rails 141. The rails are adapted to ride between V-grooved rollers 142 journaled on the fixed support structure 70 and thus support the carriage 132 for up and down movement. Such movement is effected by a cam 143 (FIG. 16) rotatable with the shaft 78 and engageable with a follower 144 on one end of a lever 145 which is supported to rock about the shaft 113. The opposite end of the lever 145 is pivotally connected at 146 to the upper end of a connecting rod 147 whose lower end is pivotally connected at 148 to the upper plate 133 of the carriage 132. A spring-loaded rod 149 is connected between the lever 145 and the support structure 70 and biases the lever in a clockwise direction about the shaft 113.

The opening mechanism 125 is completed by an air manifold 150 (FIG. 20) secured to the lower end of the plate 140 and coacting with the latter to define a plenum 151 which receives pressurized air. Pressurized jets are discharged from the plenum through a series of vertically extending passages 152 in the central portion of the manifold. As the carriage 132 is lowered, the lower side of the end portions of the manifold 150 is adapted to engage stop bumpers 153 secured to brackets 154 which extend downwardly from the support structure 70.

Figure 19:
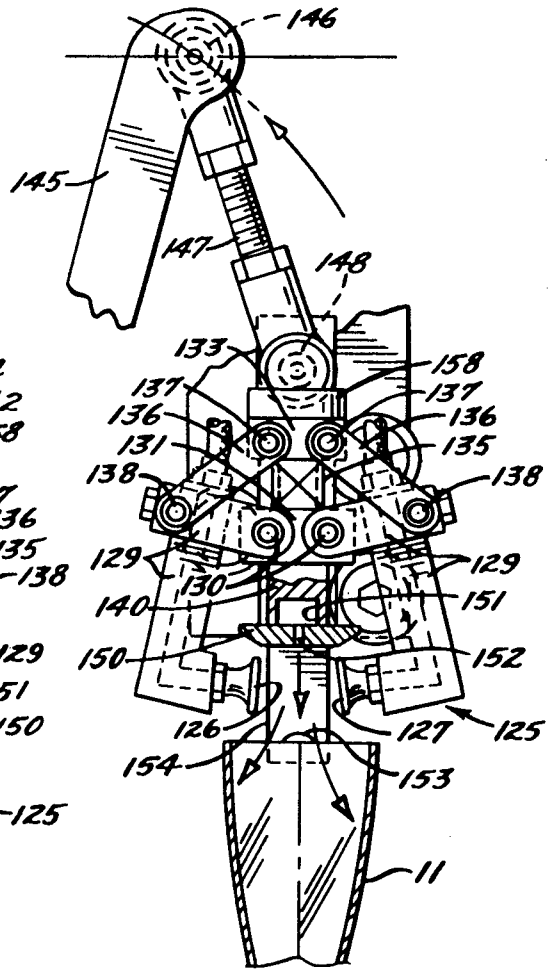
FIG. 19 is also a view similar to FIG. 17 but shows the opening mechanism after having released the pouch for advance out of the opening station.

When a pouch 11 advances into the opening station 35, the carriage 132 is disposed in a raised position and the arms 129 are spread apart to hold the suction cups 126, 127 in open positions, the position of the components being similar to that shown in FIG. 19. When the pouch dwells in the opening station, the link 147 is shifted downwardly by the lever 145. Initially, the plates 131 and 133 of the carriage move downwardly in unison and such movement causes the cups 126, 127 to move into straddling relation with the upper end portion of the pouch. Downward movement of the plates 131 and 133 in unison continues until the manifold 150 engages the bumpers 153 and stops further movement of the lower plate 131. With continued downward movement of the link 147, the upper plate 133 moves downwardly relative to the lower plate 131 as permitted by the pins 134 and the springs 135. As a result of such movement, the links 136 are forced to positions causing the arms 129 to swing toward one another and thereby bring the cups 126, 127 into engagement with the side panels of the pouch (see FIG. 17). At this time, vacuum is applied to the cups.

The link 147 then is reversed and shifted upwardly. During the first portion of upward movement of the link 147, the plate 133 moves upwardly relative to the plate 131 and causes the links 136 to swing the arms 129 in the opposite direction and open the cups 126, 127 (see FIG. 18). As the cups open, they pull the side panels of the pouch apart and cause the mouth of the pouch to open widely. At the same time, jets of pressurized air are directed downwardly into the pouch from the passages 152 in the manifold 150 and assist in opening the pouch.

Figure 18:
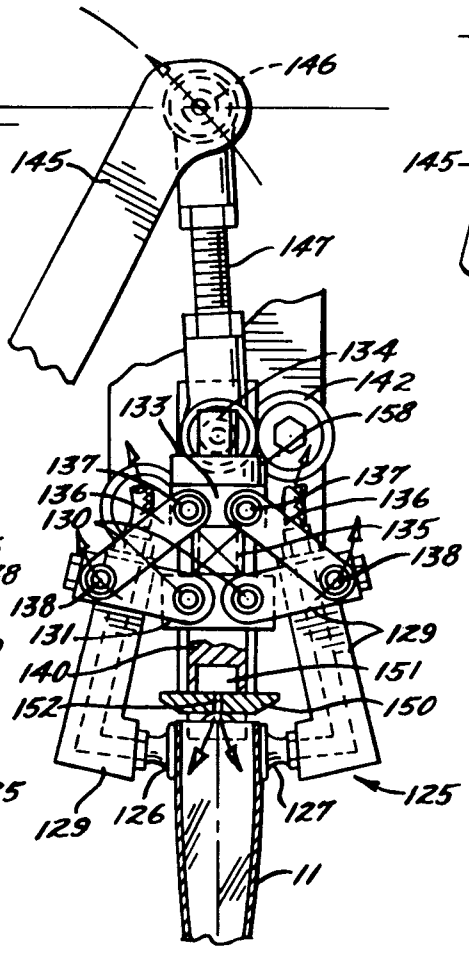
FIG. 18 is a view similar to FIG. 17 but shows the pouch opening mechanism opening the pouch.

As soon as the pouch 11 has been opened to the position shown in FIG. 18, the vacuum is released from the cups 126, 127 so as to enable the cups to release the pouch. With continued upward movement of the link 147 and the upper plate 133, the latter engages stop collars 158 (FIG. 20) on the pins 134 and acts through the pins to pull the lower plate 131 and the manifold 150 upwardly. As a result, the cups 126, 127 are lifted clear of the upper end of the pouch as shown in FIG. 19 in order to free the pouch to advance out of the opening station 35 and toward the filling mechanisms 36. During such advance, the pouch passes beneath a hood (not shown) which directs pressurized air downwardly into the pouch to help keep the pouch open for filling. The pouch also is held open during its advance to the filling mechanisms by virtue of the pouch clamps 50 being crowded laterally toward one another by the inwardly offset guide channels 121 of the chains 42, 43.

Thus, it will be apparent that opening of the pouch 11 is effected by puckering the pouch with the clamps 50, by pulling the side panels of the pouch apart with the suction cups 126, 127 and by injecting pressurized air into the pouch. By virtue of puckering the pouch and moving the side seals laterally toward one another, the side panels of the pouch are collapsed sufficiently to provide adequate material between the side seals to enable the suction cups to pull the side panels away from one another and effect smooth opening of the pouch.

As discussed above, one advantage of advancing the pouches 11 broadwise through the filling section 14 is that pouches of all widths may be kept centered laterally on a common datum line. When the machine 10 is changed over to run pouches of a different width, the chains 42, 43 must be adjusted laterally away from one another if the change is to a pouch of wider width and must be adjusted laterally toward one another if the change is to a pouch of narrower width.

Figure 23:
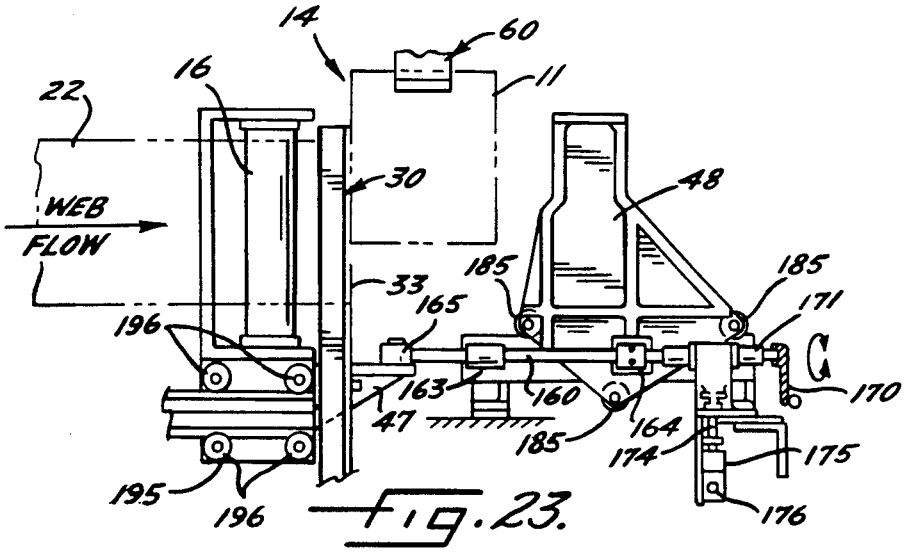
FIGS. 23 and 24 are fragmentary cross-sections taken substantially along the lines 23—23 and 24—24, respectively, of FIG. 22.

According to another aspect of the invention, comparatively simple and easy-to-operate means are provided for simultaneously adjusting the chains 42 and 43 in laterally opposite directions and through equal distances when the machine 10 is changed over to run pouches 11 of a different width. Herein, these means comprise a pair of laterally extending lead screws 160 and 161 (FIGS. 23 and 24) located at the upstream and downstream ends, respectively, of the chains 42, 43 and each having a left-hand threaded portion and a right-hand threaded portion. The screws are journaled to rotate by fixed frame members 163. The screw 160 is threaded into a right-hand nut 164 (FIG. 23) fixed to the upstream end of the conveyor base 48 and to a left-hand nut 165 fixed to the upstream end of the conveyor base 47 while the screw 161 is threaded into a right-hand nut 166 (FIG. 24) fixed to the downstream end of the conveyor base 48 and a left-hand nut 167 fixed to the downstream end of the conveyor base 47. Accordingly, when the screws are rotated, the bases 47 and 48 are adjusted laterally in opposite directions and through equal distances.

In the present instance, rotation of the screw 160 is effected by a hand crank 170 (FIG. 23) coupled to a shaft 71 which, in turn, is connected to the screw 160. A gear box 173 is associated with the shaft 171 and acts through a shaft 174, a gear box 175, a shaft 176, a gear box 177, a shaft 178 and a gear box 179 to turn the screw 161 simultaneously with the screw 160 when the hand crank 170 is turned.

The bases 47 and 48 of the chains 42, 43 carry rollers 185 which ride along fixed frame members to enable lateral adjustment of the bases with relatively little effort.

Advantageously, the feed rolls 16 and the cutter 30 are adjusted automatically when the conveyor base 47 is adjusted. The feed rolls and the cutter are supported on an extension 195 (FIG. 23) of the base, the extension carrying rollers 196 which ride along a fixed frame member. When the machine 10 is changed over to run pouches of a different width, the base 47 is adjusted through a distance equal to one-half the difference between the width of the previous run of pouches and the width of the new run of pouches. The cutter 30 is adjusted in unison with the base and is automatically located in a position to cut midway between the vertical seals of the new run of pouches. Because the feed rolls 16 are adjusted with the cutter, a constant spacing is maintained between the feed rolls and the cutter regardless of the width of the pouches.

We claim:

1. A packaging machine comprising means for longitudinally and intermittently advancing an elongated strip of interconnected pouches horizontally and edgewise along a first predetermined path and in an upright plane to a cut-off station, means at said cut-off station for cutting a pouch from the leading end portion of the strip each time the strip dwells, a selectively openable and closable gripper adjacent said cut-off station and operable to grip the leading pouch after such pouch has been advanced into the cut-off station and prior to cutting of the pouch from said strip, a plurality of spaced sets of first and second pouch clamps each adapted to be selectively opened and closed, means for intermittently and horizontally advancing said clamps transversely of said path and for causing a set of first and second clamps to dwell in an open condition and in opposing relation above said cut-off station each time a pouch dwells in said station, means for raising said gripper after the leading pouch has been cut from the strip thereby to cause the gripper to deliver the gripped and severed pouch upwardly and edgewise to the set of clamps dwelling above the cut-off station, and means for closing such clamps and opening said gripper while the clamps are dwelling above the cut-off station, said clamps moving the pouch horizontally and broadwise along a second path extending transversely of said first path during the next advance of said clamps.

2. A packaging machine as defined in claim 1 in which said gripper includes a carriage supported to move upwardly and downwardly, first and second jaws movable with said carriage, said first jaw being supported to move on said carriage between open and closed positions relative to said second jaw, and means for moving said carriage upwardly, moving said first jaw from said closed position to said open position, moving said carriage downwardly, and moving said first jaw from said open position to said closed position.

3. A packaging machine as defined in claim 1 in which said means for advancing said clamps comprise first and second laterally spaced chains having opposing inboard runs disposed in a horizontal plane, the inboard runs of said chains extending substantially perpendicular to said first path.

4. A packaging machine as defined in claim 3 further including means for simultaneously adjusting said chains laterally in opposite directions and through equal distances.

5. A packaging machine as defined in claim 3 in which said chains advance successive pouches to an opening station where each pouch dwells momentarily, and means for causing a portion of the inboard run of said first chain to shift laterally toward the inboard run of said second chain a said opening station when each pouch dwells in said opening station thereby to cause the clamp of the first chain to move toward the opposing clamp of the second chain and assist in opening the pouch in the opening station.

6. A packaging machine as defined in claim 5 further including means for also causing a portion of the inboard run of said second chain to shift laterally toward the inboard run of said first chain when each pouch dwells in said opening station thereby to cause the clamp of the second chain to move toward the opposing clamp of the first chain and assist in opening the pouch in the opening station.

7. A packaging machine as defined in claim 5 further including means for keeping said portion of the inboard run of said first chain shifted laterally inwardly toward the inboard run of said second chain as the clamps in the opening station advance downstream therefrom thereby to hold the pouch in the clamps in an open condition during such advance.

8. A packaging machine as defined in claim 6 further including means for keeping said portion of said inboard run of each chain shifted laterally inwardly toward the inboard run of the other chain as the clamps in the opening station advance downstream therefrom thereby to hold the pouch in the clamps in an open condition during such advance.

9. A method for cutting pouches from an elongated strip of interconnected pouches and for subsequently advancing the severed pouches, said method comprising the steps of, intermittently advancing the strip horizontally and edgewise along a first predetermined path and in an upright plane to a cut-off station, gripping one portion of the leading pouch of the strip when the strip dwells with the leading pouch disposed in the cut-off station, severing the gripped pouch from the strip at the cut-off station, raising the gripped pouch substantially vertically and edgewise from the cut-off station to a vertically spaced level, gripping the raised pouch along its side margins and then releasing the grip at said one portion of the pouch, and thereafter advancing the pouch broadwise along a generally horizontal path located at said level and extending transversely of said first path while the pouch is gripped along its side margins.

10. A method as defined in claim 9 in which the leading pouch is gripped adjacent its upper end and between its side margins when such pouch dwells in said cut-off station.

11. A packaging machine comprising first and second laterally spaced chains having outboard runs and opposed inboard runs all disposed in a generally horizontal plane, means for advancing said chains intermittently and horizontally, pouch clamps secured to and spaced along each of said chains, the clamps on the inboard run of said first chain being paired with and disposed in opposing relation with the clamps on the inboard run of said second chain and coacting with the clamps of the second chain to hold pouches and to advance successive pouches broadwise to an opening station where each pouch dwells momentarily, and means for causing a portion of the inboard run of said first chain to shift laterally toward the inboard run of said second chain at said opening station when each pouch dwells in said station thereby to cause the clamp of the first chain to move toward the opposing clamp of the second chain and assist in opening the pouch in the station.

12. A packaging machine as defined in claim 11 further including means for also causing a portion of the inboard run of said second chain to shift laterally toward the inboard run of said first chain when each pouch dwells in said opening station thereby to cause the clamp of the second chain to move toward the opposing clamp of the first chain and assist in opening the pouch in the station.

13. A packaging machine as defined in claim 11 further including means for keeping said portion of the inboard run of said first chain shifted laterally inwardly toward the inboard run of said second chain as the clamps in the opening station advance downstream therefrom thereby to hold the pouch in the clamps in an open condition during such advance.

14. A packaging machine as defined in claim 12 further including means for keeping said portion of said inboard run of each chain shifted laterally inwardly toward the inboard run of the other chain as the clamps in the opening station advance downstream therefrom thereby to hold the pouch in the clamps in an open condition during such advance.

15. A packaging machine as defined in claim 11 further including means in said opening station for engaging the side panels of each pouch dwelling the opening station and for pulling such side panels away from one another to help open the pouch.

16. A packaging machine as defined in claim 15 in which said engaging means comprise a pair of opposing vacuum cups each adapted to have a vacuum applied thereto and released therefrom and spaced from one another along the direction of advance of said pouches, a carriage mounted for up and down movement adjacent said opening station, said cups being mounted to move upwardly and downwardly with said carriage, said cups being mounted on said carriage to move relative to said carriage between open and closed positions, said cups being located in said open positions when a pouch dwells in said opening station and being located above said pouch, and means operable as such pouch dwells for sequentially lowering said carriage to cause said cups to straddle said pouch, for moving said cups to said closed positrons to cause the cups to engage the side panels of the pouch, for applying vacuum to the cups, for moving said cups to said open positions to cause the cups to pull the side panels of the pouch away from one another, for releasing the vacuum from the cups, and for shifting said carriage upwardly to raise the cups above the pouch.

17. A packaging machine as defined in claim 16 further including means for keeping said portion of the inboard run of said first chain shifted laterally inwardly toward the inboard run of said second chain as the clamps in the opening station advance downstream therefrom thereby to hold the pouch in the clamps in an open condition during such advance.

18. A packaging machine as defined in claim 16 further including means for injecting pressurized air downwardly into each pouch as the pouch dwells in the opening station.

19. A packaging machine as defined in claim 18 further including means for keeping said portion of the inboard run of said first chain shifted laterally inwardly toward the inboard run of said second chain as the clamps in the opening station advance downstream therefrom thereby to hold the pouch in the clamps in an open condition during such advance.

* * * * *